US009966679B2

(12) United States Patent
Xu et al.

(10) Patent No.: US 9,966,679 B2
(45) Date of Patent: May 8, 2018

(54) ELECTRICAL CONNECTOR HAVING CONTACTS WITH DUAL CONTACTING BEAMS THEREOF

(71) Applicant: FOXCONN INTERCONNECT TECHNOLOGY LIMITED, Grand Cayman (KY)

(72) Inventors: Qin Xu, Kunshan (CN); Zhuang-Xing Li, Kunshan (CN); Wen-Jun Tang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/681,450

(22) Filed: Aug. 21, 2017

(65) Prior Publication Data

US 2018/0054010 A1 Feb. 22, 2018

(30) Foreign Application Priority Data

Aug. 19, 2016 (CN) ..... 2016 1 0687408

(51) Int. Cl.
*H01R 4/48* (2006.01)
*H01R 12/72* (2011.01)
*H01R 12/52* (2011.01)

(52) U.S. Cl.
CPC ..... *H01R 12/721* (2013.01); *H01R 12/523* (2013.01); *H01R 2201/06* (2013.01)

(58) Field of Classification Search
CPC .. H01R 12/7076; H01R 13/629; H01R 13/62; H01R 13/7175; H01R 12/7005; H01R 13/64
USPC ..... 439/630, 629, 152, 327, 607.54, 607.1, 439/159, 681, 637
See application file for complete search history.

(56) References Cited

U.S. PATENT DOCUMENTS 3,631,381 A 12/1971 Pittman
5,478,259 A * 12/1995 Noschese ..... H01R 23/6873 439/108
5,688,147 A * 11/1997 Coteus ..... H01R 12/7005 439/633
5,842,880 A * 12/1998 Pei ..... H01R 12/7005 439/327
5,957,708 A * 9/1999 Lin ..... H01R 12/7005 439/157

(Continued)

*Primary Examiner* — Abdullah Riyami
*Assistant Examiner* — Nader Alhawamdeh
(74) *Attorney, Agent, or Firm* — Wei Te Chung; Ming Chieh Chang

(57) ABSTRACT

The terminal is used within a card edge connector. Each terminal includes a base, a connecting tail extending downwardly form the base, first and second extending sections commonly extending upwardly from the base while spaced from each other, and first and second contacting sections respectively extending from the corresponding extending sections and into the central slot wherein all the base, the extending sections, the contacting sections and the connecting section lie in a same plane. The first contacting section is lower than the second contacting section. The first extending section is closer to the central slot than the second extending section is, and has more deflected regions thereof than the second extending section for increasing the length and the corresponding resiliency thereof.

19 Claims, 7 Drawing Sheets

(56) References Cited

U.S. PATENT DOCUMENTS 6,093,046 A * 7/2000 Chiou ..... H01R 12/7005 439/378
6,322,388 B1 * 11/2001 Akio ..... H01R 13/5812 439/459
6,663,402 B1 * 12/2003 Yu ..... H01R 13/65802 439/108
6,672,887 B1 * 1/2004 Yu ..... H01R 13/65802 439/108
6,695,630 B1 * 2/2004 Ku ..... H05K 7/1431 439/152
6,821,149 B2 * 11/2004 Lai ..... H01R 23/6873 439/607.31
7,108,554 B2 * 9/2006 Huang ..... H01R 23/6873 439/378
7,207,815 B1 * 4/2007 Ju ..... H01R 12/7029 439/159
7,442,093 B2 * 10/2008 Li ..... H01R 12/721 439/633
7,491,092 B2 * 2/2009 Zhu ..... H01R 13/6456 439/633
7,637,783 B2 12/2009 Sasaoka et al.
7,771,232 B2 * 8/2010 Si ..... H01R 12/716 439/607.01
8,038,459 B2 * 10/2011 Hayauchi ..... H01R 13/5213 439/301
8,092,239 B2 * 1/2012 Nishiyama ..... H01R 12/7005 439/157
8,794,988 B2 * 8/2014 Tanaka ..... H01R 12/83 439/326
2005/0277334 A1 * 12/2005 Huang ..... H01R 23/6873 439/607.01
2007/0254526 A1 * 11/2007 Lai ..... H05K 1/18 439/637
2010/0323549 A1 * 12/2010 Hayauchi ..... H01R 13/5213 439/357
2012/0135618 A1 * 5/2012 Shen ..... H01R 12/721 439/152
2013/0084723 A1 * 4/2013 Shen ..... H01R 12/7029 439/159
2013/0095679 A1 * 4/2013 Li ..... H01R 12/7005 439/157
2015/0318627 A1 * 11/2015 Berry, Jr. ..... H01R 12/7076 714/6.32
2016/0020539 A1 * 1/2016 Li ..... H01R 12/707 439/155
2016/0020540 A1 * 1/2016 Shen ..... G06F 1/203 439/155

* cited by examiner

ELECTRICAL CONNECTOR HAVING CONTACTS WITH DUAL CONTACTING BEAMS THEREOF

BACKGROUND OF THE DISCLOSURE

1. Field of the Disclosure

The invention is a card edge connector, and particularly to the electrical connector having the corresponding contact with dual independent contacting beams thereof.

2. Description of Related Arts

U.S. Pat. No. 7,637,783 discloses a card edge connector having the contact with dual contacting beams. Because the dual contacting beams are formed with the corresponding widths facing the central slot, the contact may require to take relatively more space along the longitudinal direction of the housing, thus precluding the fine pitch arrangement. U.S. Pat. No. 3,631,381 discloses a card edge connector having the contact with dual contacting beams too wherein the dual contacting beams are formed by blanking/stamping instead of forming to have the thickness side of the dual contacting beams face the central slot, thus allowing the fine pitch arrangement along the longitudinal direction of the housing. Anyhow, because such a contact is downwardly loaded into the corresponding contact passageway, the corresponding contact passageway is required to be set in an upward opening status, thus jeopardizing the desired structural strength around the central slot. In addition, those dual contacting beams extend in a vertical direction, thus lacking the superior resilient characteristics thereof.

A superior electrical card edge connector with the dual contacting beams is desired

SUMMARY OF THE DISCLOSURE

To achieve the above desire, an electrical card edge connector includes an elongated insulative housing having two opposite side walls extending along the longitudinal direction, a pair of opposite end walls linked on two opposite ends thereof, and an upward open central slot formed among the opposite side walls and opposite end walls. Two rows of terminals are disposed in the corresponding side walls, respectively. Each terminal includes a base retaining to the side wall, a connecting tail extending downwardly form the base, first and second extending sections commonly extending upwardly from the base while spaced from each other, and first and second contacting sections respectively extending from the corresponding extending sections and into the central slot wherein all the base, the extending sections, the contacting sections and the connecting section lie in a same plane. The first contacting section is lower than the second contacting section. The first extending section is closer to the central slot than the second extending section is, and has more deflected regions thereof than the second extending section for increasing the length and the corresponding resiliency thereof.

DETAILED DESCRIPTION OF THE PREFERRED EMBODIMENT

Figure 1:
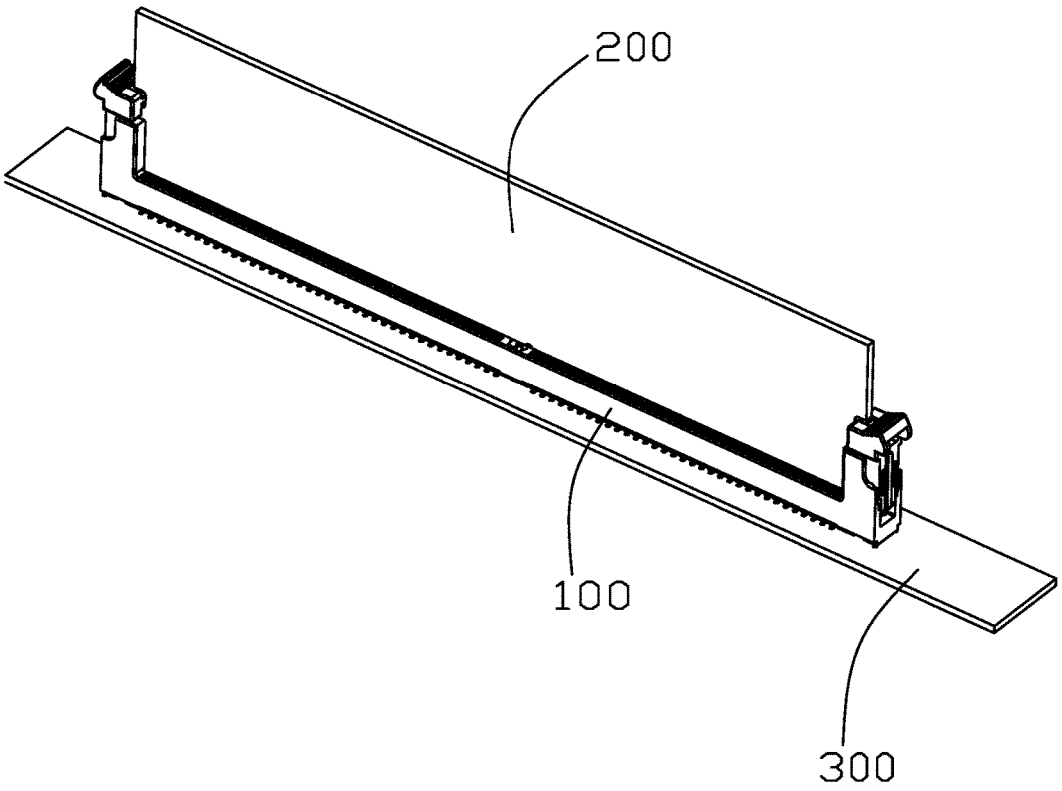
FIG. 1 is a perspective view of an electrical card edge connector assembly having the electrical card edge connector mounted upon a printed circuit board with an electronic card therein according to the invention.
Figure 2:
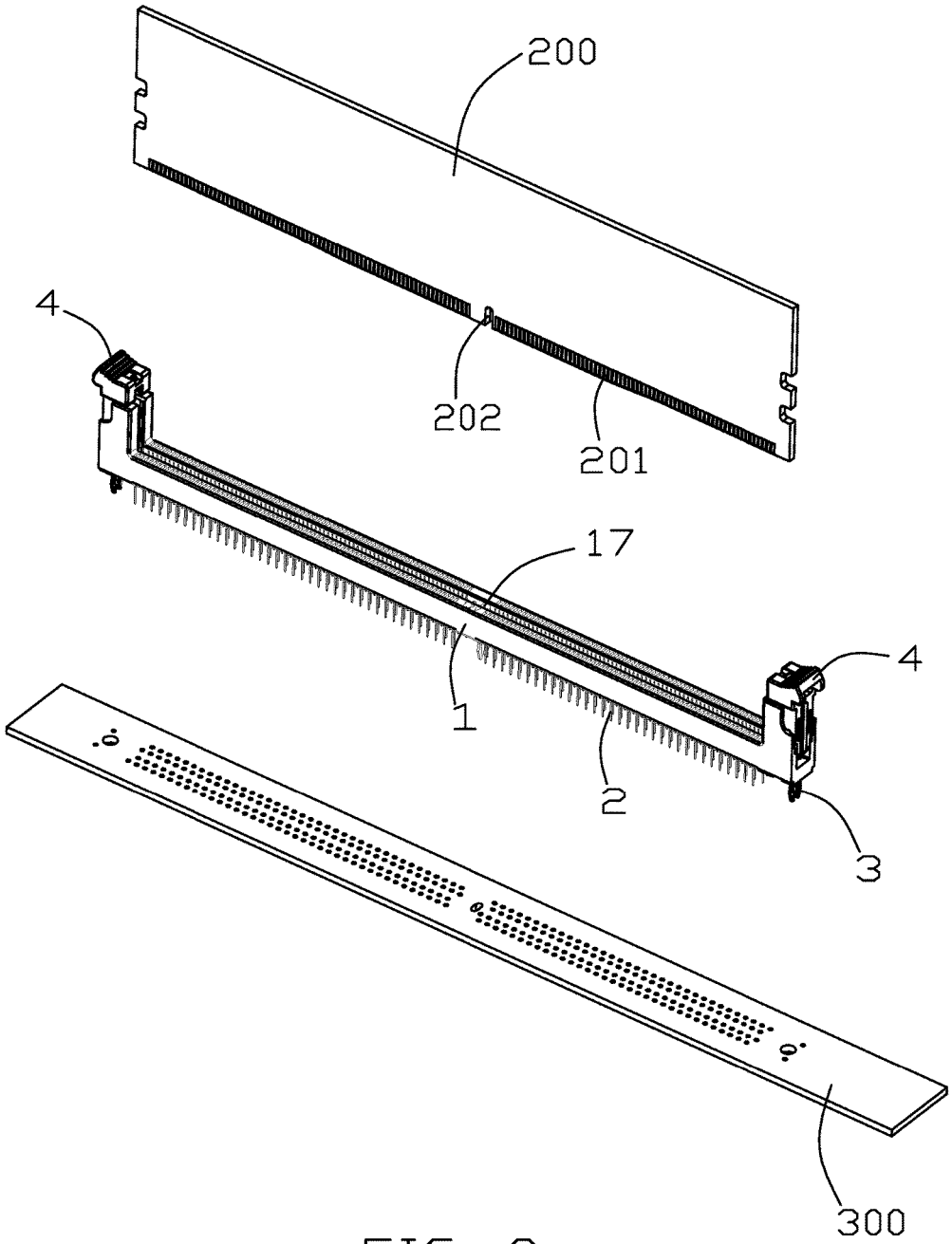
FIG. 2 is an exploded perspective view of the electrical connector assembly of FIG. 1.
Figure 3:
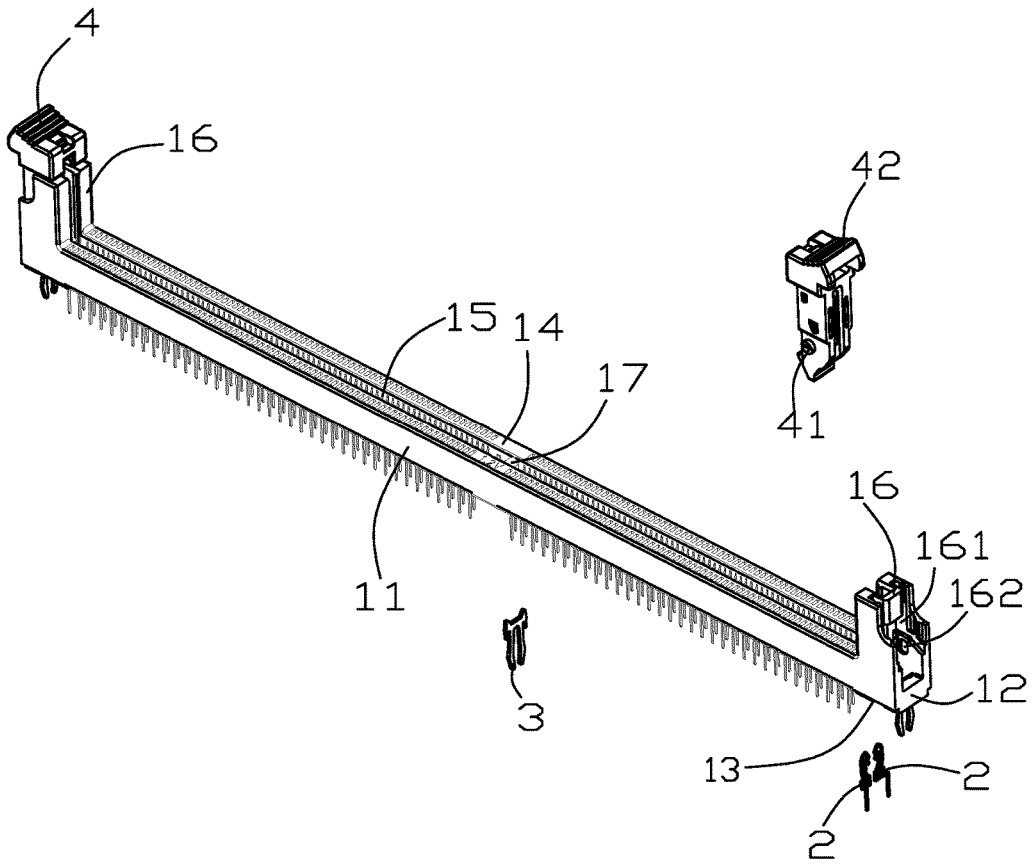
FIG. 3 is an exploded perspective view of the electrical card edge connector of the electrical connector assembly of FIG. 1.
Figure 4:
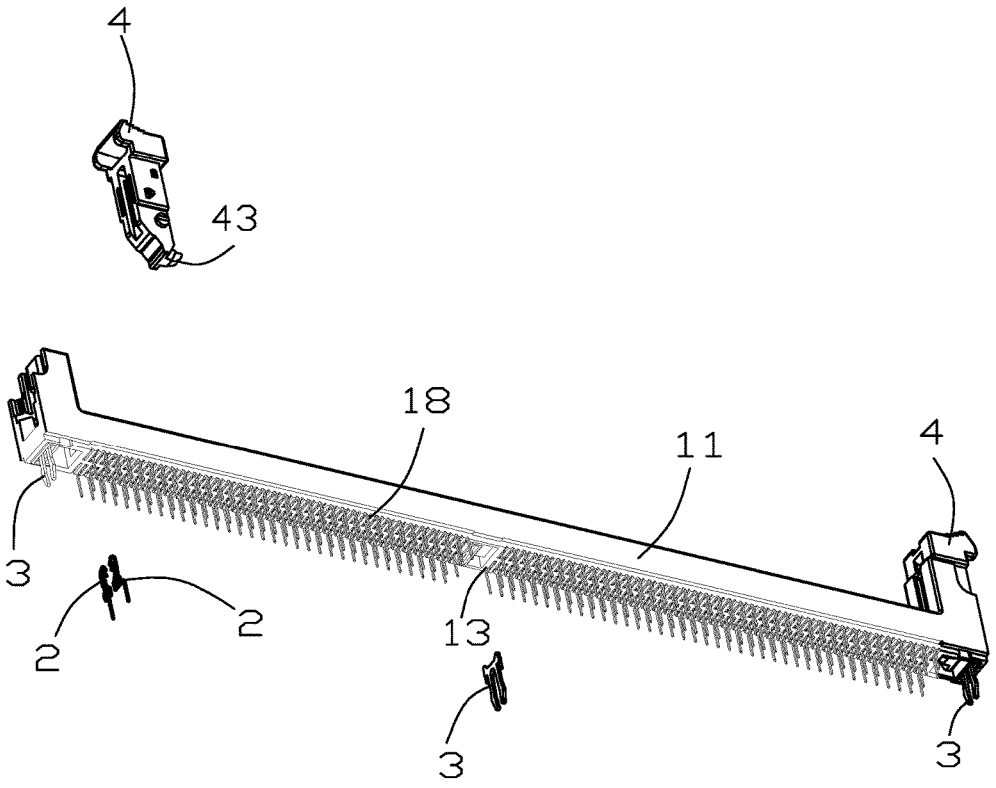
FIG. 4 is another exploded perspective view of the electrical card connector of FIG. 3.
Figure 5:
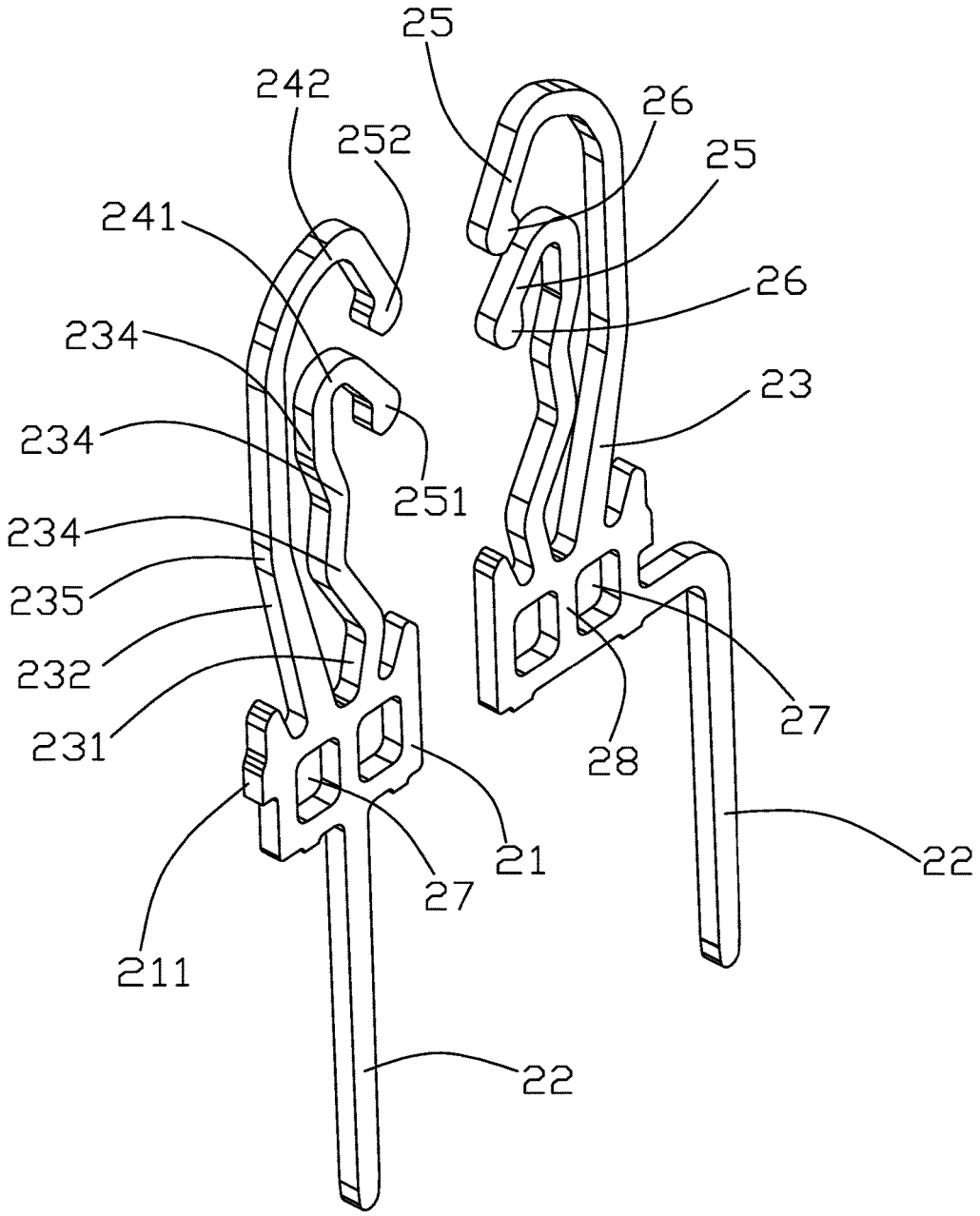
FIG. 5 is a perspective view of the contacts of the electrical card edge connector of FIG. 1.
Figure 6:
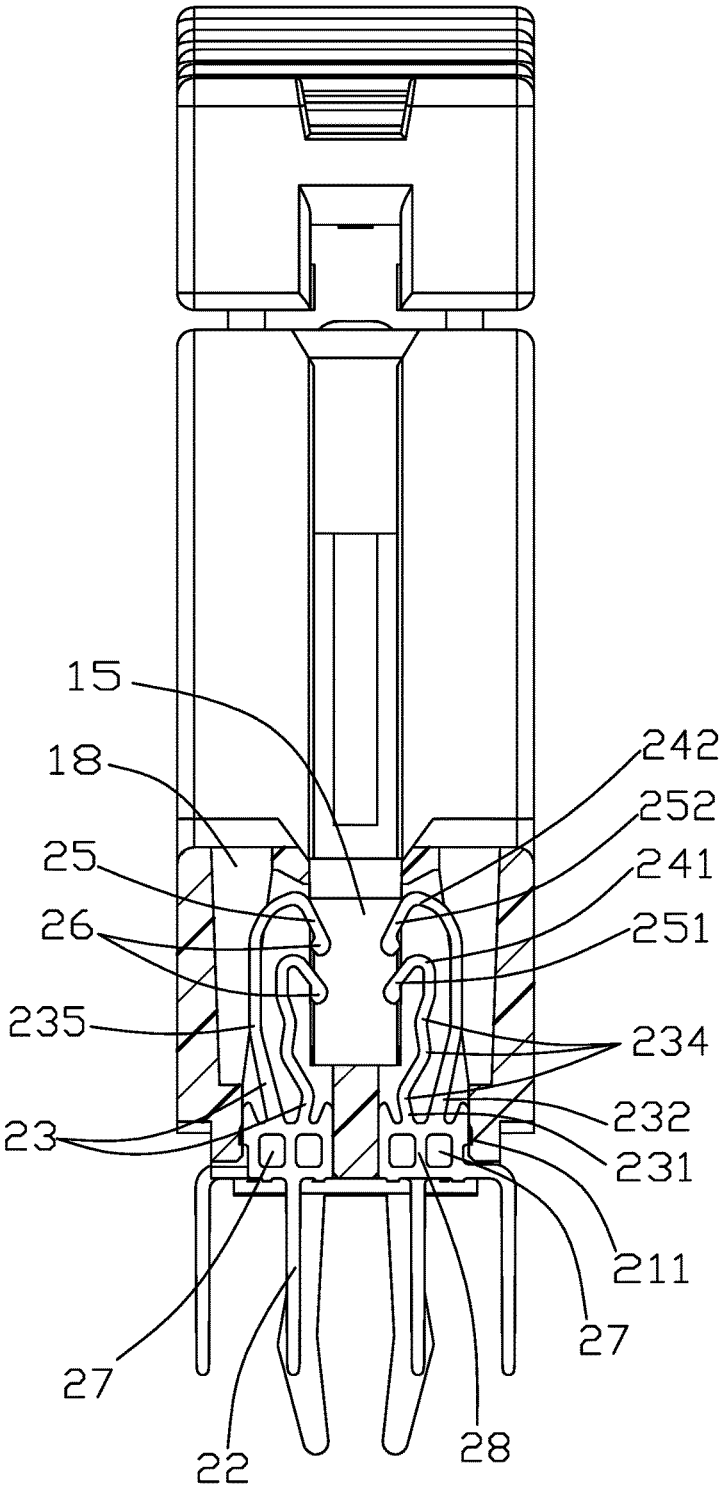
FIG. 6 is a cross-sectional view of the electrical card connector of FIG. 5.
Figure 7:
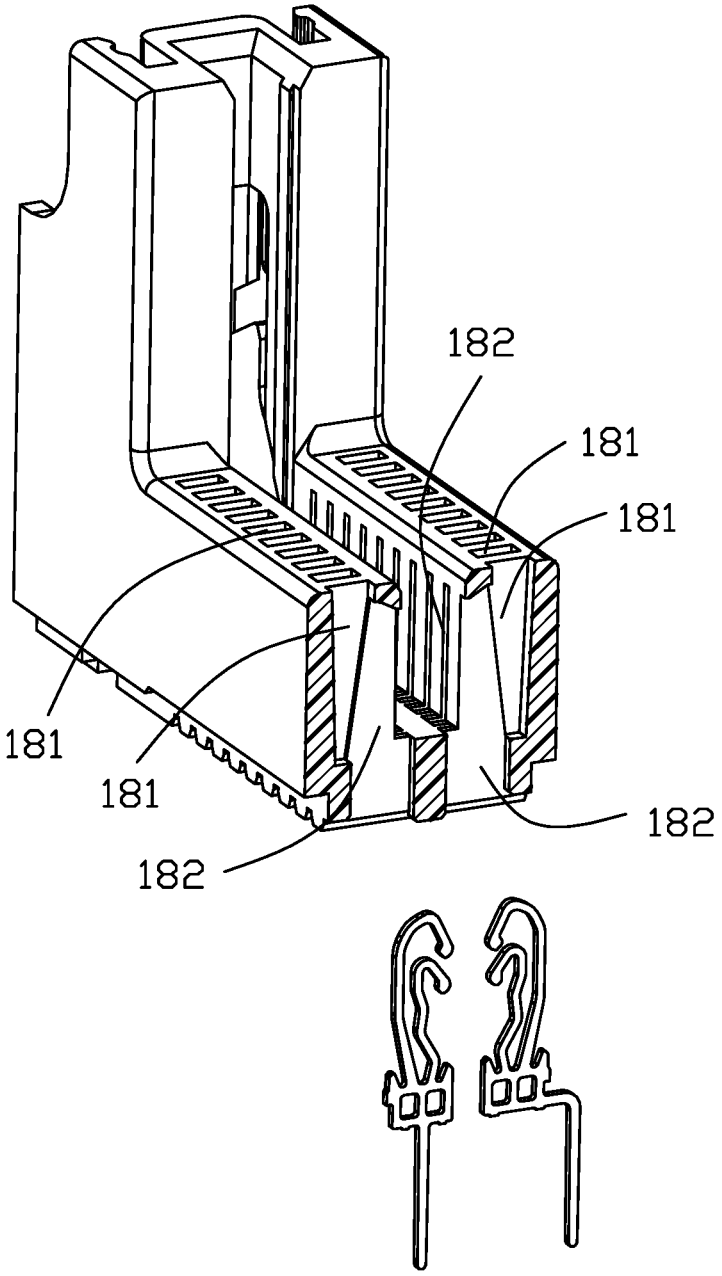
FIG. 7 is a partial cut-away perspective view of the housing of the electrical card edge connector of FIG. 1 with a pair of contacts thereof.

Referring to FIGS. 1-7, an electrical connector assembly includes an electrical card edge connector 100 mounted upon a printed circuit board 300 and receiving a memory module or electronic card 200 therein. The connector 100 includes an insulative housing 1, a plurality of terminals 2 disposed in the housing 1, a plurality of board locks 3 and a pair of rotatable latches 4.

The housing 1 includes a pair of opposite side walls 11 extending along a longitudinal direction, a pair of opposite end walls 12 linked at two opposite ends of the side walls 11, a bottom wall 13 seated upon the printed circuit board 300, and a top wall 14 opposite to the bottom wall 13. The side walls 11 and the end walls 12 commonly form an upward central slot 15. A plurality of passageways 18 are formed in each side wall 11, and each passageway 18 extends through the bottom wall 13 and the top wall 14 in the vertical direction, and through an interior surface of the side wall 11 in the transverse direction. A key 17 is formed in the central slot 15 for mating with a downward notch 202 of the electronic card 200 for assuring only one orientation of the electronic card 200 with regard to the connector 100. A pair of tower portions 16 are respectively located around the end walls 12 and extend upward above the top wall 14. The latches 4 are pivotally mounted to the corresponding tower portions 16. The tower portion 16 includes a receiving cavity 161 and the pivotal holes 162 facing the receiving cavity 161, and the latch 4 includes a pivotal shaft 41 and the handler 42. Understandably, downwardly loading the electronic card 200 into the central slot 15 may urge the footer 43 of the latch 4 to be downward pivoted and have the latch locked within the side notch of the electronic card 200; oppositely, downwardly pushing the handler 42 may rotate the latch 4 to have the footer 43 eject out of the central slot 15.

The plurality of terminals 2 are arranged in two rows respectively located in the corresponding side walls 11. Each terminal 12 is upwardly inserted into the corresponding passageway 1. Each terminal 12 has a base 21 assembled to the corresponding side wall 11, a connecting tail 22 downwardly extending from the housing 1 and beyond the bottom wall 13, two (first and second) extending sections 23 upwardly extending from the base 21, and two (first and second) contacting sections 25 respectively extending from the two extending sections 23 and into the central slot 15. Notably, both first and second contacting sections 25 contact the same conductive pad on the electronic card 200 for assuring constant connection disregarding the possible failure of one of those two contacting sections 2. All the base 21, the connecting tail 22, the extending sections 23 and the contacting sections 25 are made via blanking and common lie in a transverse plane defined by the transverse direction and the vertical direction, thus achieving a fine pitch arrangement of the terminals 2 along the longitudinal direction. The two extending sections 23 include a first extending section 231 and a second extending section 232 wherein the first extending section is closer to the central slot 15 than the second extending section 232 is, and has more deflected regions thereof than the second extending section 232 for increasing the length and the corresponding resiliency thereof.

The first extending section 231 includes at least three deflected regions 234 which are deflected oppositely between every adjacent two thereof. The second extend region 232 includes at least one deflected region 235, Notably, the first extending section 231 and the second extending section 232 are adjusted to have the similar length thereof for impedance match.

The two contacting sections 25 include a first contacting section 251 extending from the first extending section 231, and a second contacting section 252 extending from the second extending section 232 wherein both the first contacting section 251 and the second contacting section 252 extend in the same direction, i.e., the downward direction while the first contacting section 251 is located under the second contacting section 252. A first bending section 241 is linked between the first extending section 231 and the first contacting section 251, and the second bending section 242 is linked between the second contacting section 252 and the second extending section 232 wherein both the first bending section 241 and the second bending section 242 are of an upside-down V-shaped configuration, thus efficiently resisting downward loading of the electronic card 200 into the central slot 15 without crash. A contacting point 26 of the first contacting section 251 and that of the second contacting section 252 are dimensioned to be essentially same. In brief, the first contacting section 251 and the associated first extending section 231 commonly form a first contacting beam, and the second contacting section 252 and the associated second extending section 232 commonly form a second contacting beam, wherein such first contacting beam and second contacting beam are spaced from and independently operated with each other and have different configurations and different contacting positions acted on a same conductive pad on the electronic card 200. Anyhow, both the first contacting beam and the second contacting beam are of ear-like configurations commonly inwardly facing the central slot in the transverse direction.

The base 21 is wider than other portions in the transverse direction and has an interference section 211, with 0.20 mm length thereof, on the outer side edge while no interference section on the inner side edge. The base 21 further formed two holes 27 divided by the divider 28 wherein the first extending section 231 and the second extend section 232 respectively extend above the corresponding holes 27 in the vertical direction for the whole desired rigidity and resiliency thereof.

In this embodiment, the passageway 18 includes an outer wide section 181 and an inner narrow section 182 wherein a dimension of the outer wide section is larger than that of the inner narrow section along the longitudinal direction. In essence, the thickness of the terminal 2 is similar to the narrow section 182 so as to not only assure the contacting sections 25 extend into the central slot 15 in a properly guiding manner via the inner narrow section 182 but also provide the sufficient space for heat dissipation upward via the outer wider section 181 wherein an interface between the outer wider section 181 and the inner narrow section 182 is a step structure extending in an angled direction oblique to both the vertical direction and the transverse direction.

While a preferred embodiment in accordance with the present disclosure has been shown and described, equivalent modifications and changes known to persons skilled in the art according to the spirit of the present disclosure are considered within the scope of the present disclosure as described in the appended claims. For example, the connecting tail in this embodiment is used for insertion into a through hole of the printed circuit board 300 while a surface-mounting connecting tail may be used in another embodiment.

What is claimed is:

1. An electrical card edge connector for connecting a printed circuit board and an electronic card, comprising:

an elongated insulative housing including a pair of opposite side walls extending along a longitudinal direction with a central slot therebetween in a transverse direction perpendicular to said longitudinal direction, a pair of opposite end walls located at two opposite ends of said side walls, said central slot upwardly communicating with an exterior in a vertical direction perpendicular to both said longitudinal direction and said transverse direction for receiving said electronic card;

a plurality of passageways forms in each of said side walls, each of said passageways communicating inwardly with the central slot in the transverse direction and upwardly with the exterior in the vertical direction;

a plurality of terminals retained in the corresponding passageways, respectively, each of said terminals being unitary and made by blanking to wholly extend in a transverse plane defined by the transverse direction and said vertical direction, each of said terminals including a base, a connecting tail extending from the base for connecting to the printed circuit board, an inner first contacting beam and an outer second contacting beam commonly upwardly extending from the base, the inner first contacting beam being closer to the central slot than the outer second contacting beam, the first contacting beam including a first extending section connected to the base and a first contacting section extending from the first extending section and into the central slot, the second contacting beam including a second extending section connected to the base and a second contacting section extending from the second extending section and into the central slot, the first contacting section being located under the second contacting section, wherein the first extending section includes a plurality of deflected regions more than that of the second extending section.

2. The electrical card edge connector as claimed in claim 1, wherein a first bending section is linked between the first extending section and the first contacting section, and a second bending section is linked between the second extending section and the second contacting section, and both said first bending section and said second bending section are of an upside-down V-shaped configuration, and the first bending section is located under the second bending section.

3. The electrical card edge connector as claimed in claim 1, wherein the base includes two holes with a divider therebetween in the transverse direction, and the first extending section and the second extending section are located above said two holes in the vertical direction, respectively.

4. The electrical card edge connector as claimed in claim 1, wherein the base forms barbed structure on an outer lateral side edge while no barbed structure is formed on an inner lateral side edge thereof.

5. The electrical card edge connector as claimed in claim 1, wherein said connecting tail extends downwardly for insertion into a through hole of the printed circuit board.

6. The electrical card edge connector as claimed in claim 1, wherein each of said passageways includes an inner narrow section and an outer wide section having a larger dimension than the inner narrow section in the longitudinal direction, and the corresponding terminal is essentially compliantly disposed in the inner narrow section.

7. The electrical card edge connector as claimed in claim 6, wherein an interface between the inner narrow section and the outer wide section is a step structure extending along a direction oblique to both said vertical direction and said transverse direction.

8. The electrical card edge connector as claimed in claim 1, further including a pair of tower portions respectively located at two opposite end walls.

9. The electrical card edge connector as claimed in claim 8, wherein each of said tower portions is equipped with a latch.

10. The electrical card edge connector as claimed in claim 1, wherein both the first contacting beam and the second contacting beam are of ear-like configurations inwardly facing the central slot in the transverse direction.

11. An electrical card edge connector for connecting a printed circuit board and an electronic card, comprising:

an elongated insulative housing including a pair of opposite side walls extending along a longitudinal direction with a central slot therebetween in a transverse direction perpendicular to said longitudinal direction, a pair of opposite end walls located at two opposite ends of said side walls, said central slot upwardly communicating with an exterior in a vertical direction perpendicular to both said longitudinal direction and said transverse direction for receiving said electronic card;

a plurality of passageways forms in each of said side walls, each of said passageways communicating inwardly with the central slot in the transverse direction and upwardly with the exterior in the vertical direction;

a plurality of terminals retained in the corresponding passageways, respectively, each of said terminals being unitary and made by blanking to wholly extend in a transverse plane defined by the transverse direction and said vertical direction, each of said terminals including a base, a connecting tail extending from the base for connecting to the printed circuit board, an inner first contacting beam and an outer second contacting beam commonly upwardly extending from the base, the inner first contacting beam being closer to the central slot than the outer second contacting beam, the first contacting beam including a first extending section connected to the base and a first contacting section extending from the first extending section and into the central slot, the second contacting beam including a second extending section connected to the base and a second contacting section extending from the second extending section and into the central slot, the first contacting section being located under the second contacting section, wherein each of said passageways includes an inner narrow section and an outer wide section having a larger dimension than that of the inner narrow section in the longitudinal direction, and the corresponding terminal is essentially compliantly disposed in the inner narrow section.

12. The electrical card edge connector as claimed in claim 11, wherein an interface between the inner narrow section and the outer wide section is a step structure extending along a direction oblique to both said vertical direction and said transverse direction.

13. The electrical card edge connector as claimed in claim 11, wherein the base includes two holes with a divider therebetween in the transverse direction, and the first extending section and the second extending section are located above said two holes in the vertical direction, respectively.

14. The electrical card edge connector as claimed in claim 11, wherein both the first contacting beam and the second contacting beam are of ear-like configurations inwardly facing the central slot in the transverse direction.

15. The electrical card edge connector as claimed in claim 11, wherein the base forms barbed structure on an outer lateral side edge while no barbed structure is formed on an inner lateral side edge thereof.

16. An electrical card edge connector for connecting a printed circuit board and an electronic card, comprising:

an elongated insulative housing including a pair of opposite side walls extending along a longitudinal direction with a central slot therebetween in a transverse direction perpendicular to said longitudinal direction, a pair of opposite end walls located at two opposite ends of said side walls, said central slot upwardly communicating with an exterior in a vertical direction perpendicular to both said longitudinal direction and said transverse direction for receiving said electronic card;

a plurality of passageways forms in each of said side walls, each of said passageways communicating inwardly with the central slot in the transverse direction and upwardly with the exterior in the vertical direction;

a plurality of terminals retained in the corresponding passageways, respectively, each of said terminals being unitary and made by blanking to wholly extend in a transverse plane defined by the transverse direction and said vertical direction, each of said terminals including a base, a connecting tail extending from the base for connecting to the printed circuit board, an inner first contacting beam and an outer second contacting beam commonly upwardly extending from the base, the inner first contacting beam being closer to the central slot than the outer second contacting beam, the first contacting beam including a first extending section connected to the base and a first contacting section extending from the first extending section and into the central slot, the second contacting beam including a second extending section connected to the base and a second contacting section extending from the second extending section and into the central slot, the first contacting section being located under the second contacting section, wherein the base includes two holes with a divider therebetween in the transverse direction, and the first extending section and the second extending section are located above said two holes in the vertical direction, respectively.

17. The electrical card edge connector as claimed in claim 16, wherein both the first contacting beam and the second contacting beam are of ear-like configurations inwardly facing the central slot in the transverse direction.

18. The electrical card edge connector as claimed 17, wherein the first extending section includes a plurality of deflected regions more than that of the second extending section.

19. The electrical card edge connector as claimed in claim 16, wherein the base forms barbed structure on an outer lateral side edge while no barbed structure is formed on an inner lateral side edge thereof.

* * * * *